US006560710B1

(12) United States Patent
Leyden et al.

(10) Patent No.: US 6,560,710 B1
(45) Date of Patent: May 6, 2003

(54) SECURITY SYSTEM FOR PORTABLE COMPUTER, AND THE LIKE

(75) Inventors: Roger Leyden, Willow Springs, IL (US); Peter Passuntino, Wheaton, IL (US); David Schroeder, Elmhurst, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 0 days.

(21) Appl. No.: 09/313,553

(22) Filed: May 14, 1999

(51) Int. Cl.[7] ..... G08B 13/14
(52) U.S. Cl. ..... 713/200; 340/572; 340/568
(58) Field of Search ..... 340/556, 506, 340/521, 525.49, 569, 572.1, 573.1, 568, 568.2; 713/200

(56) References Cited

U.S. PATENT DOCUMENTS 4,990,888 A * 2/1991 Vogt et al. ..... 340/506
D335,439 S 5/1993 Leyden et al.
5,246,183 A 9/1993 Leyden
D345,092 S 3/1994 Leyden et al.
5,341,124 A 8/1994 Leyden et al.
5,421,667 A 6/1995 Leyden et al.
5,552,771 A 9/1996 Leyden et al.
5,565,848 A 10/1996 Leyden et al.
5,577,855 A 11/1996 Leyden et al.
5,676,258 A 10/1997 Leyden et al.
6,081,420 A * 6/2000 Kim et al. ..... 361/681

* cited by examiner

*Primary Examiner*—Ly V. Hua
(74) *Attorney, Agent, or Firm*—Wood, Phillips, Katz, Clark & Mortimer

(57) ABSTRACT

The combination of an article to be monitored and a security system. The article to be monitored has a first component and a second component projecting angularly from the first component. The security system has a base and a cover movable guidingly relative to the base between first and second positions. The cover has a first opening through which the second component projects. The cover defines a receptacle for the first component with the second component projecting through the first opening. The cover has an entry opening which allows a) the second component to be selectively projected through and withdrawn from the first opening and b) the first component to be selectively placed in and removed from the receptacle with the cover in the first position. The base and cover cooperatively prevent c) the second component from being withdrawn from the first opening and d) the first component from being removed from the receptacle with the cover in the second position. The security system further includes a lock assembly which interconnects between the base and cover and is placeable selectively in locked and released states. The lock assembly in the locked state maintains the cover in the second position. The lock assembly in the released state allows the cover to move from the second position into the first position.

20 Claims, 4 Drawing Sheets

30
36
20
62
60
100
52
26
10
42
44
20
54
24
12
96
88
38
34
28
16
14
86
94
50
18

SECURITY SYSTEM FOR PORTABLE COMPUTER, AND THE LIKE

BACKGROUND OF THE INVENTION

1. Field of the Invention

This invention relates to security systems of the type used to maintain computer equipment, and the like, in a prescribed area for display thereof.

2. Background Art

Consumer theft is an ever increasing problem as products become smaller, yet more expensive. This is particularly true in the area of computers. High performance laptop computers are now packaged in compact cases which, while facilitating transportation by a user, likewise makes them prone to unauthorized and undetected removal from stores at which they are displayed.

In the highly competitive electronics industry, purveyors of this type of equipment generally compromise between maintaining security and prominently displaying electronic items to allow them to be inspected and used on site by a potential customer. In large electronics stores, a multitude of products, including laptop computers, can be seen openly displayed on shelves. The consumer is allowed to pick these items up, inspect them, and operate them in a normal manner as part of the process of making a purchasing decision. While this style of marketing is an accommodation to an honest, potential customer, it likewise offers a temptation to a would be thief.

Inevitably, to recover theft costs, store owners increase the price of merchandise. The industry is constantly looking for effective ways to display and market consumer products without the fear of significant product loss so that store owners can realize workable profits while maintaining reasonable prices for consumers.

SUMMARY OF THE INVENTION

In one form, the invention is directed to the combination of an article to be monitored and a security system. The article to be monitored has a first component and a second component projecting angularly from the first component. The security system has a base and a cover movable guidingly relative to the base between first and second positions. The cover has a first opening through which the second component projects. The cover defines a receptacle for the first component with the second component projecting through the first opening. The cover has an entry opening which allows a) the second component to be selectively projected through and withdrawn from the first opening and b) the first component to be selectively placed in and removed from the receptacle with the cover in the first position. The base and cover cooperatively prevent c) the second component from being withdrawn from the first opening and d) the first component from being removed from the receptacle with the cover in the second position. The security system further includes a lock assembly which interconnects between the base and cover and is placeable selectively in locked and released states. The lock assembly in the locked state maintains the cover in the second position. The lock assembly in the released state allows the cover to move from the second position into the first position.

In one form, the article to be monitored is a computer, with the first component including a keyboard and the second component including a display.

The cover may have an inverted U shape in cross section with a base through which the first opening is formed.

The base may have a cut-out to permit access to the keyboard with the first component in the receptacle.

With the first component in the receptacle, the display may project through the first opening to outside of the receptacle to be visible outside of the receptacle.

In one form, the first and second components are pivotably connected to each other so that different angular relationships between the first and second components can be selected with the first component in the receptacle and the second component projected through the first opening.

In one form, there is a guide rail on one of the cover and base and a slot for the guide rail on the other of the cover and base. The guide rail is movable guidingly within the slot as the cover moves between the first and second positions.

The base may have an anchoring tab thereon. In one form, the lock assembly has a bar that extends into the anchoring tab and cover.

In one form, the cover has an inverted U shape in cross section with a base and spaced legs. In one form, the bar projects through both of the spaced legs.

In one form, the bar has a head, a body, and a free end. The free end of the bar is directed in one direction through the spaced legs and the anchoring tab. The lock assembly may further have a lock element that is releasably connectable to the free end of the bar. With the lock element releasably connected to the free end of the bar, the cover is captively held between the head of the bar and the lock element.

The lock element may be key operated.

In one form, the base is fixedly attached to a support for the article to be monitored and the security system.

The security system may further including a tether which is connected between a support and at least one of the cover, base, and lock assembly.

The tether may have at least one electrical conductor therein defining a conductive path.

In one form, the security system further has a monitor which detects interruption of the conductive path and produces a detectable signal as an incident of detecting interruption of the conductive path.

The invention is also directed to a security system having a base and a cover movable guidingly relative to the base between first and second positions. The cover has an inverted U shape in cross section with a base and spaced legs which define a receptacle for a first part of an article to be monitored. The base has a first opening therethrough through which a second part of an article to be monitored, that projects angularly from a first part of an article to be monitored, can project with the first part of an article to be monitored in the receptacle. The cover has an entry opening which allows a) the second part of an article to be monitored to be selectively projected through and withdrawn from the first opening and b) the first part of an article to be monitored to be selectively placed in and removed from the receptacle with the cover in the first position. The base and cover cooperatively prevent c) the second part of an article to be monitored to be withdrawn from the first opening and d) the first part of an article to be monitored to be removed from the receptacle, with the cover in the second position. The security assembly further includes a lock assembly interconnecting between the base and cover and placeable selectively in locked and released states. The lock assembly in the locked state maintains the cover in the second position. The lock assembly in the released state allows the cover to move from the second position into the first position.

In one form, the base has a flat bottom wall. First and second guide rails are provided on at least one of the cover and base with slots for the guide rails on at least one of the cover and base. The guide rails move guidingly in the slots as the cover is moved between the first and second positions. The cover blocks more of the entry opening with the cover in the second position than with the cover in the first position.

DETAILED DESCRIPTION OF THE DRAWINGS

Figure 1:
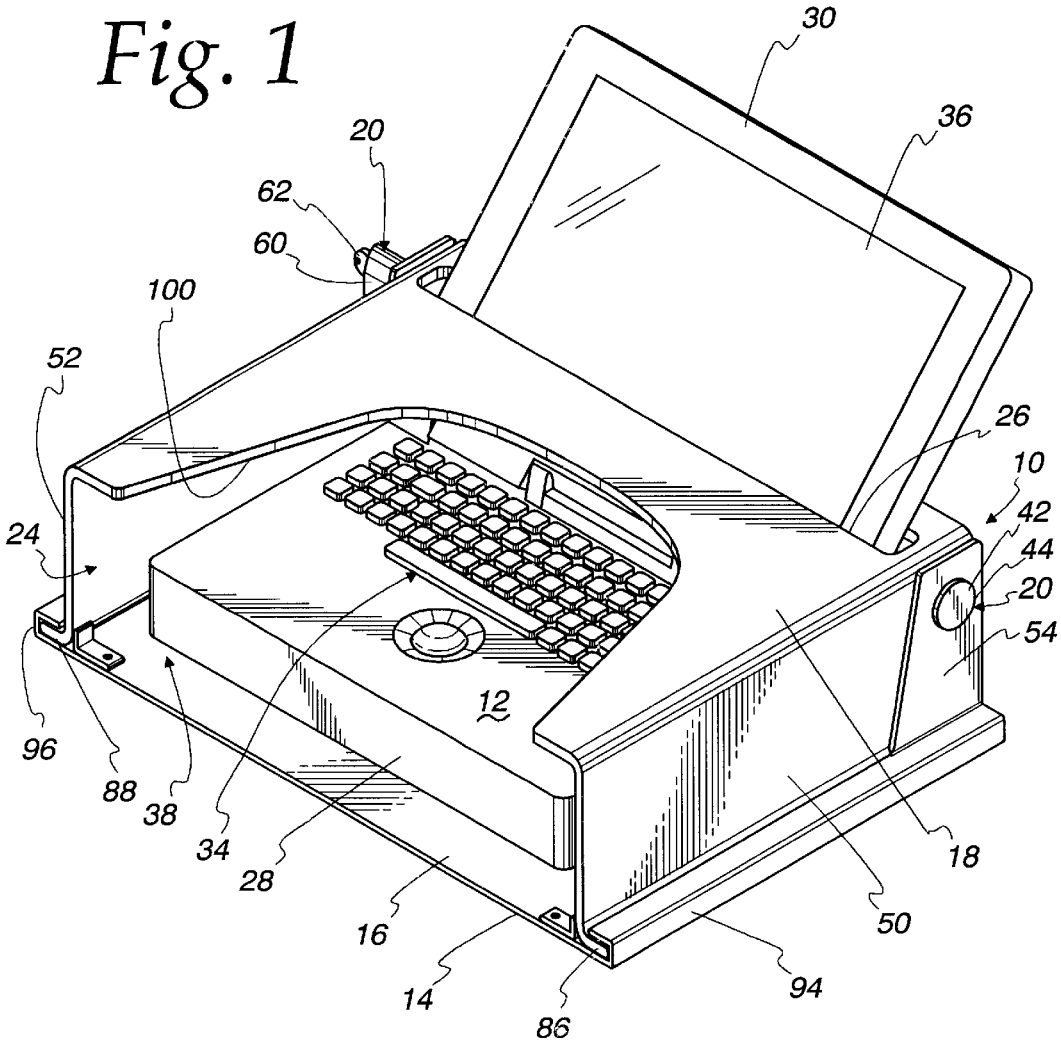
FIG. 1 is a perspective view of a security system, according to the present invention, shown in conjunction with a portable, laptop computer.
Figure 2:
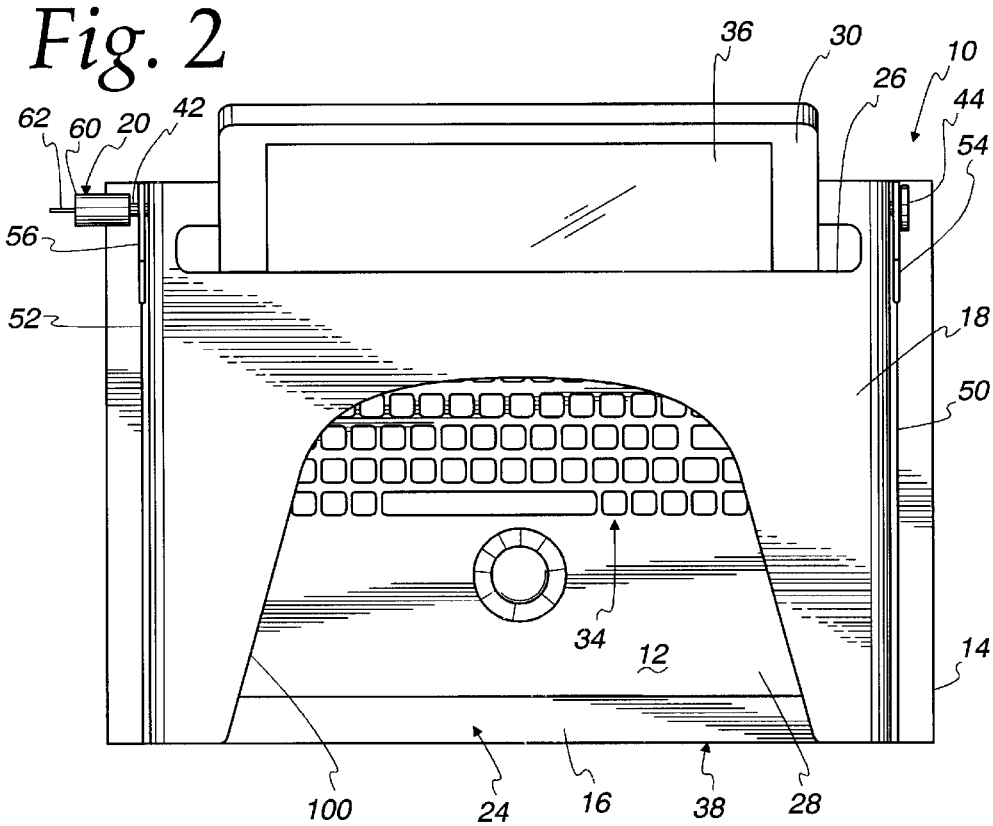
FIG. 2 is a plan view of the security system and laptop computer of FIG. 1.
Figure 3:
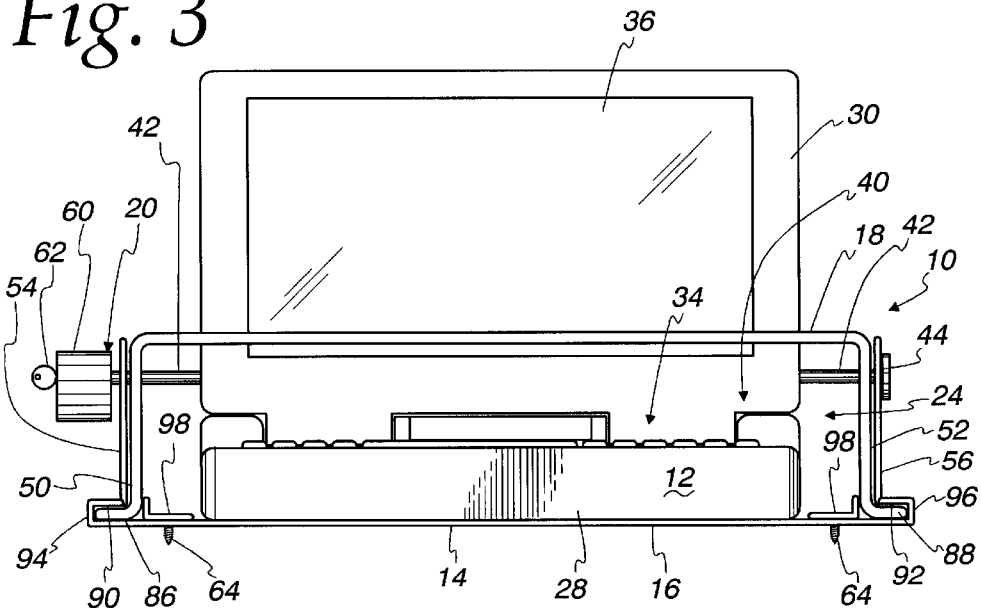
FIG. 3 is a front elevation view of the security system and laptop computer of FIGS. 1 and 2.

In the drawings, a security system, according to the present invention, is shown at 10, for monitoring a portable article, which in this case is a laptop computer 12. The security system 10 can be used to monitor other than the laptop computer 12 shown, and is particularly adaptable for use in monitoring articles having angularly oriented components. The security system 10 will be described below as used with of the laptop computer 12, however, it should be recognized that the article(s) to be monitored using the security system 10 is not so limited.

The security system 10 consists of a base 14 with a flat wall 16, a cover 18 and a lock assembly at 20. The cover 18 is movable relative to the base 14 between a first position, shown in FIG. 7, and a second position, shown in each of FIGS. 1–6. With the cover 18 in the first position therefor, the computer 12 can be directed upwardly relative to the cover 18 through an entry opening 22 into a receptacle 24 defined by the cover 18.

The security system 10 is designed so that part of the article to be monitored that is in the receptacle 24 is projected through an opening 26 in the cover 18. The computer 12 has first and second components 28, 30 which are pivotably connected to each other through a hinge arrangement at 32 in conventional manner. In this case, the first component 28 includes a keyboard 34 and the second component 30 includes a monitor/display 36. The second component 30 is angularly oriented relative to the first component 28 in a normal operating position so that with the first component 28 in the receptacle 24, the second component 30, including the display 36 thereon, projects upwardly to be visible outside of the receptacle 24.

With the computer 12 situated relative to the cover 18, as described above, the cover 18 can be moved to the second position relative to the base 14. In the second position, the flat wall 16 reduces the dimension of the entry opening 22 sufficiently that the computer 12 cannot be removed from the receptacle 24. The dimensions of the receptacle 24 and the location of the opening 26 are selected so that the components 28, 30 of the computer 12 cannot be repositioned relative to each other so as to allow the computer 12 to be removed from the receptacle 24 by movement thereof through either a front opening 38 or a rear opening 40 on the cover 18.

The lock assembly 20 maintains the cover 18 in the second position therefor. The lock assembly 20 includes a bar 42 having a head 44, a body 46, and a free end 48. The free end 48 of the bar 42 is directed through spaced walls 50, 52 on the cover 18 and through anchoring tabs 54, 56 directed upwardly from the flat wall 16 on the base 14 and situated, one each adjacent to the cover walls 50, 52. The head 44 limits translational movement of the bar 42 in one direction. In this position, the free bar end 48 is exposed outside of the cover wall 52. The exposed portion of the free end 48 has an undercut 58 which can be engaged by a lock element 60 that is operable through a key 62 to extend a tab (not shown) into the undercut 58. Once in place, the lock 60 and head 44 captively engage the cover 18 and prevent withdrawal of the bar 42. The tab is extended into the undercut 58 with the lock assembly 20 in a locked state. Through the key 62, the lock assembly 20 can be placed in a released state wherein the lock element 60 can be separated from the bar 42. Additional details of a suitable bar and lock element arrangement are shown in U.S. Pat. No. 5,676,258, which is incorporated herein by reference.

The united subassembly, consisting of the computer 12, base 14, cover 18 and lock assembly 20, can then be confined to a prescribed area by any of a number of different means. In one form, fasteners 64, in the form of screws or bolts, can be directed through the flat wall 16 and into any suitable support 66, which effectively becomes a part of the base 14. With the base 14 fixed in this manner, the computer 12 and cover 18 prohibit access to the fasteners 66, as might facilitate their removal.

Figure 4:
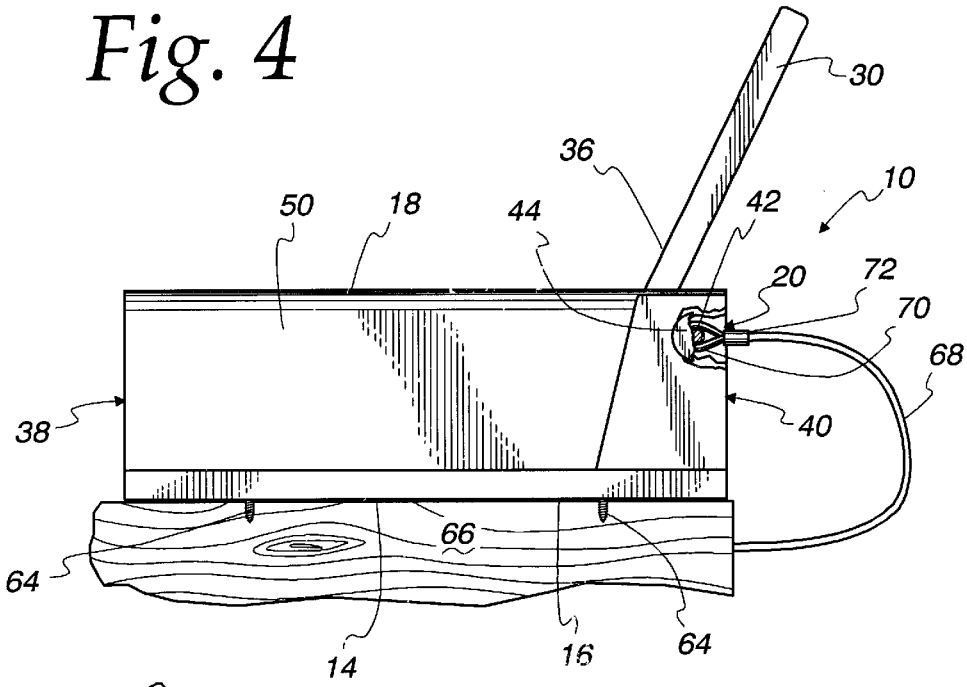
FIG. 4 is a side elevation view of the security system and laptop computer of FIGS. 1–3 with the security system further including a tether connected to a support to prevent unauthorized removal of the laptop computer from a prescribed area.
Figure 5:
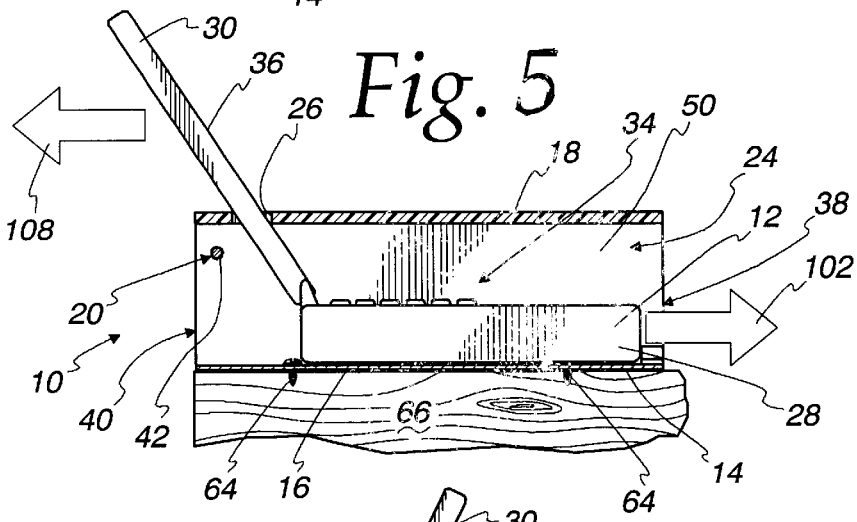
FIG. 5 is a reduced, cross-sectional view of the security system and laptop computer of FIGS. 1–4 and showing the laptop computer in one orientation.
Figure 6:
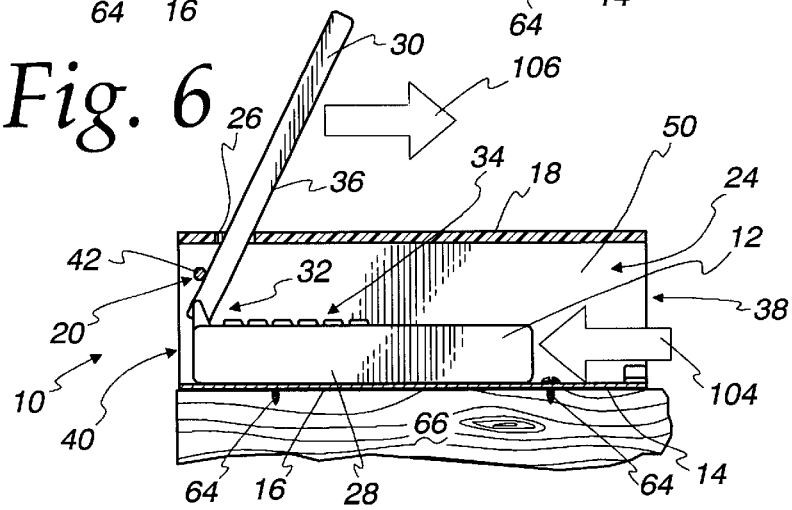
FIG. 6 is a view as in FIG. 5 with the laptop computer in another orientation.

In an alternative form, shown in FIG. 4, a tether 68, in the form of a flexible cable, is attached between the security system 10 and support 66. In the embodiment shown, the cable 68 is formed to define a loop 70 around the bar 42, which loop is maintained by a crimped element 72. This arrangement allows the security system 10 and computer 12 to be lifted and repositioned within a range determined by the length of the tether 68.

Figure 7:
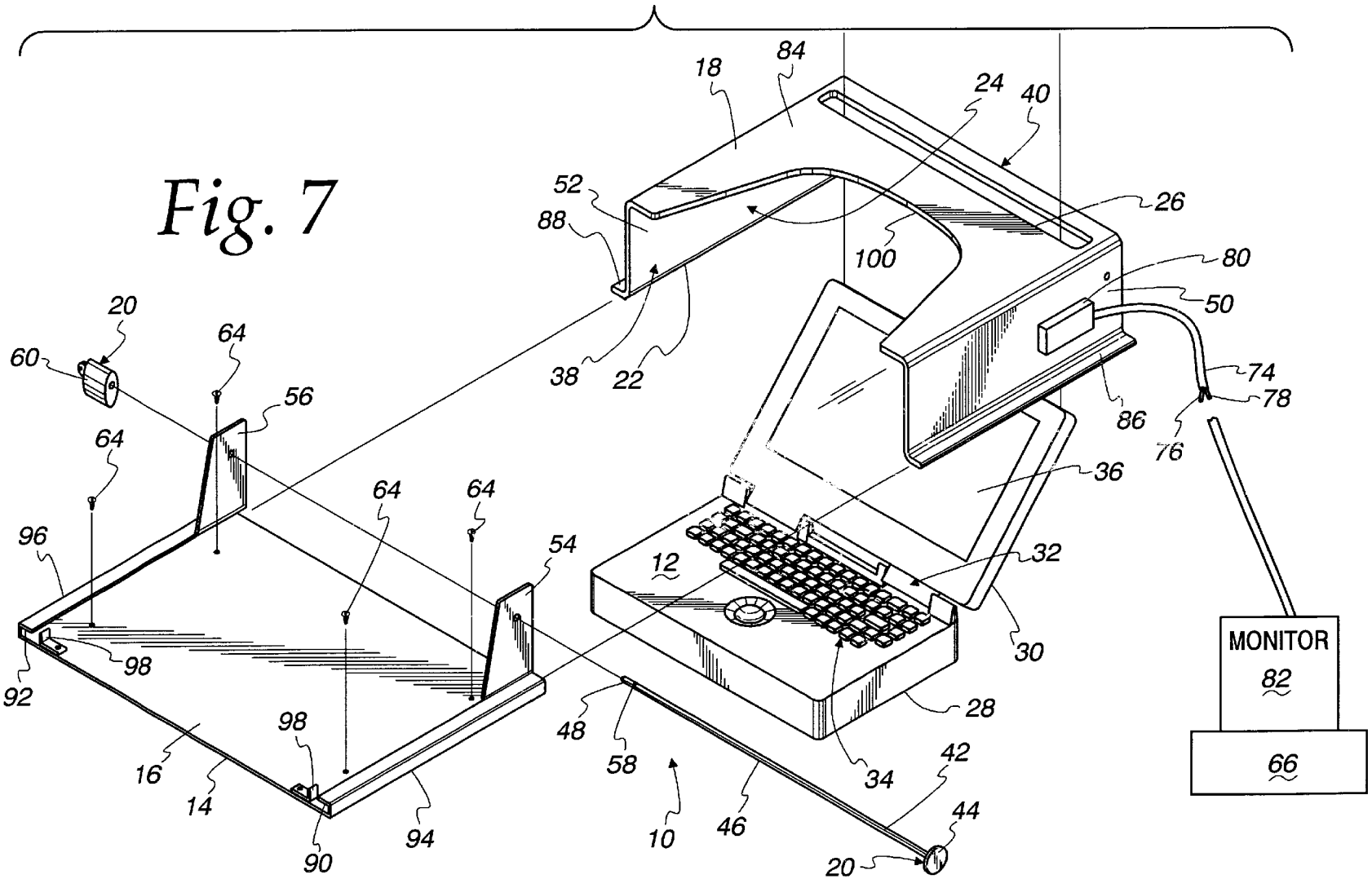
FIG. 7 is an exploded, perspective view of the security system and laptop computer of FIGS. 1–6 with the security system further including electronic monitoring structure to prevent unauthorized removal of the laptop computer from a prescribed area.

In another form, as shown in FIG. 7, a tether 74 has separate elements 76, 78 defining at least one conductive path between a sensor 80 and a monitor 82. The monitor 82 detects interruption of a conductive path defined by one or both of the conductive elements 76, 78, or removal of the sensor 80 from the cover 18, or elsewhere to which it is applied. A suitable electrical monitoring system is shown, for example, in U.S. Pat. No. 5,341,124, owned by the assignee herein and incorporated herein by reference.

To facilitate movement of the cover 18 between the first and second positions therefor, the cover 18 is formed to be U-shaped in cross section with a base 84 and spaced legs defining the walls 50, 52. The walls 50, 52 have outturned flanges 86, 88 which define rails guidable, one each, in slots 90, 92 defined by formed edges 94, 96 at the sides of the base 14. L-shaped clips 98 on the flat wall 16 confine the flanges 86, 88 to within the slots 90, 92.

The base 84 of the cover 18 has a cut-out 100 to facilitate access by a user to the keyboard 34. The cut-out 100 is dimensioned so that it does not permit the computer 12 to be repositioned so as to allow passage through the cut-out 100.

The cover 18 is dimensioned, and the opening 26 located and dimensioned, so that the first component 28 can be shifted outwardly in the direction of the arrow 102 and inwardly in the direction of the arrow 104 to effect convenient positioning thereof. At the same time, the second component 30, with the display 36, can pivot within the opening 26 to allow shifting thereof forwardly in the direction of the arrow 106, in response to rearward movement of the first component 28, and rearward shifting in the direction of the arrow 108, in response to forward shifting of the first component 28. With this arrangement, the angle of the display 36 can be conveniently repositioned for maximum visibility and to achieve the best viewing angle.

The base 14 and cover 18 may be made from metal or plastic material. In one preferred form, the cover is formed from a clear plastic sheet to allow generally unobstructed viewing of the computer 12.

The foregoing disclosure of specific embodiments is intended to be illustrative of the broad concepts comprehended by the invention.

What is claimed is:

1. In combination:

a) an article to be monitored comprising a first component and a second component projecting angularly from the first component; and b) a security system comprising:

a base;

a cover movable guidingly relative to the base between first and second positions, the cover having a first opening through which the second component projects, the cover defining a receptacle for the first component with the second component projecting through the first opening, there being an entry opening on the cover which allows a) the second component to be selectively projected through and withdrawn from the first opening and b) the first component to be selectively placed in and removed from the receptacle with the cover in the first position, the base and cover cooperatively preventing c) the second component from being withdrawn from the first opening and d) the first component from being removed from the receptacle with the cover in the second position; and a lock assembly interconnecting between the base and cover and placeable selectively in locked and released states, the lock assembly in the locked state maintaining the cover in the second position, the lock assembly in the released state allowing the cover to move from the second position into the first position.

2. The combination according to claim 1 wherein the article to be monitored is a computer, the first component comprises a keyboard, and the second component comprises a display.

3. The combination according to claim 1 wherein the cover has an inverted U shape in cross section with a base through which the first opening is defined.

4. The combination according to claim 3 wherein the cover has a cut-out to permit access to the keyboard with the first component in the receptacle.

5. The combination according to claim 3 wherein with the first component in the receptacle the display projects through the first opening to outside of the receptacle to be visible outside of the receptacle.

6. The combination according to claim 5 wherein the first and second components are pivotably connected to each other so that different angular relationship between the first and second components can be selected with the first component in the receptacle and the second component projected through the first opening.

7. The combination according to claim 1 wherein there is a guide rail on one of the cover and base and a slot for the guide rail on the other of the cover and base and the guide rail is movable guidingly within the slot as the cover moves between the first and second positions.

8. The combination according to claim 1 wherein the base has an anchoring tab thereon and the lock assembly comprises a bar that extends into the anchoring tab and cover.

9. The combination according to claim 8 wherein the cover has an inverted U shape in cross section with a base and spaced legs, and the bar projects through both of the spaced legs.

10. The combination according to claim 9 wherein the bar comprises a head, a body, and a free end, the free end of the bar is directed in one direction through the spaced legs and the anchoring tab, the locking assembly further comprises a lock element that is releasably connectable to the free end of the bar and with the lock element releasably connected to the free end of the bar the cover is captively held between the head of the bar and the lock element.

11. The combination according to claim 10 wherein the lock element is a key-operated lock element.

12. The combination according to claim 1 wherein the base is fixedly attached to a support for the article to be monitored and the security system.

13. The combination according to claim 1 wherein the security system further comprise a tether which is connected between a support and at least one of the cover, base, and lock assembly.

14. The combination according to claim 13 wherein the tether comprises at least one electrical conductor defining a conductive path.

15. The combination according to claim 14 wherein the security system further comprises a monitor which detects interruption of the conductive path and produces a detectable signal as an incident of detecting interruption of the conductive path.

16. A security system comprising:

a base;

a cover movable guidingly relative to the base between first and second positions, the cover having an inverted U shape in cross section with a base and spaced legs which define a receptacle for a first part of an article to be monitored, the base having a first opening therethrough through which a second part of an article to be monitored that projects angularly from the first part of an article to be monitored can project with the first part of an article to be monitored in the receptacle, there being an entry opening on the cover which allows a) the second part of an article to be monitored to be selectively projected through and withdrawn from the first opening and b) the first part of an article to be monitored to be selectively placed in and removed from the receptacle with the cover in the first position, the base and cover cooperatively preventing c) the second part of an article to be monitored from being withdrawn from the first opening and d) the first part of an article to be monitored from being removed from the receptacle with the cover in the second position; and a lock assembly interconnecting between the base and cover and placeable selectively in locked and released states, the lock assembly in the locked state maintaining the cover in the second position, the lock assembly in the released state allowing the cover to move from the second position into the first position.

17. The security system according to claim 16 wherein the base comprises a flat bottom wall, there are first and second guide rails on at least one of the cover and base and slots for each of the guide rails on at least one of the cover and base, the guide rails move guidingly in the slots as the cover is moved between the first and second positions, and the cover blocks more of the entry opening with the cover in the second position than with the cover in the first position.

18. The security assembly according to claim 17 wherein the base has an anchoring tab and the lock assembly comprises a bar that extends into the anchoring tab and cover.

19. The security assembly according to claim 18 wherein the bar projects through both of the spaced legs.

20. The security assembly according to claim 19 wherein the bar comprises a head, a body, and a free end, the free end of the bar is directed in one direction through the spaced legs and the anchoring tab, the locking assembly further comprises a lock element that is releasably connectable to the free end of the bar, and with the lock element releasably connected to the free end of the bar the cover is captively held between the head of the bar and the lock element.

* * * * *